United States Patent [19]

Galvin

[11] 4,195,286

[45] Mar. 25, 1980

[54] ALARM SYSTEM HAVING IMPROVED FALSE ALARM RATE AND DETECTION RELIABILITY

[75] Inventor: Aaron A. Galvin, Lexington, Mass.

[73] Assignee: American District Telegraph Company, New York, N.Y.

[21] Appl. No.: 867,479

[22] Filed: Jan. 6, 1978

[51] Int. Cl.[2] ..... G08B 29/00

[52] U.S. Cl. ..... 340/501; 340/522; 340/587

[58] Field of Search ..... 340/522, 526, 566, 587, 340/541, 584, 540, 501, 500, 521

[56] References Cited

U.S. PATENT DOCUMENTS

| | | | |
|---|---|---|---|
| 3,543,261 | 11/1970 | Burney | 340/566 |
| 3,599,195 | 8/1971 | Boyko | 340/521 |
| 4,090,180 | 5/1978 | Barowitz et el. | 340/566 |

*Primary Examiner*—Glen R. Swann, III

*Attorney, Agent, or Firm*—Weingarten, Maxham & Schurgin

[57] ABSTRACT

An alarm system has two output modes, one providing relatively high detection probability and the other providing relatively low false alarm probability. Two or more sensors are coupled to an associated logic circuit which provides a first alarm output in response to actuation of any one of the sensors, and a second alarm output in response to actuation of the two or more sensors within a predetermined time interval.

5 Claims, 1 Drawing Figure

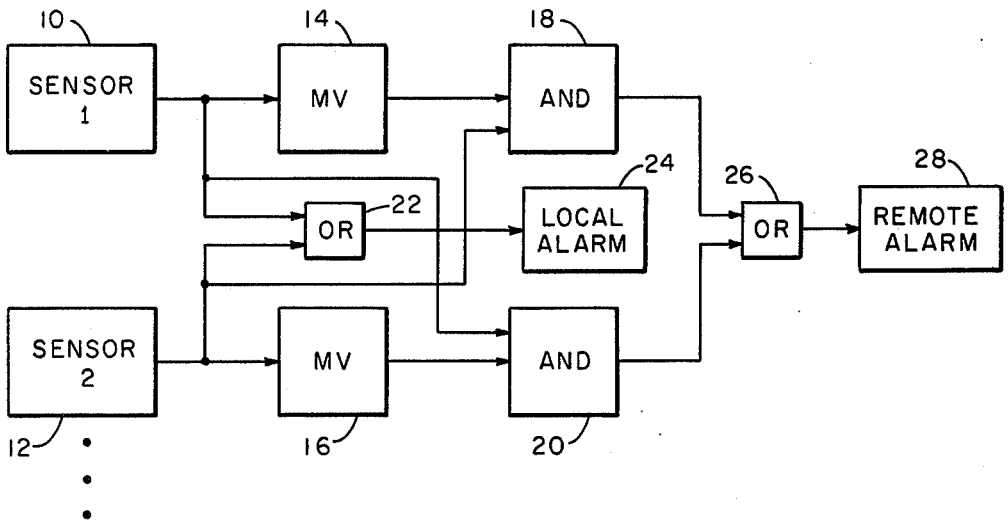
10
SENSOR 1
14
MV
18
AND
22
OR
24
LOCAL ALARM
26
OR
28
REMOTE ALARM
SENSOR 2
MV
AND
12
16
20

ALARM SYSTEM HAVING IMPROVED FALSE ALARM RATE AND DETECTION RELIABILITY

FIELD OF THE INVENTION

This invention relates to alarm systems and more particularly to a system employing multiple sensors and providing improved detection reliability and false alarm reduction.

BACKGROUND OF THE INVENTION

Alarm systems are known in which two or more sensors are embodied with associated logic circuits to achieve false alarm rates which are substantially less than the rates of a system employing a single sensor. Such redundant or multiple alarm systems for providing false alarm reduction are described for example in U.S. Pat. Nos. 3,074,053 and 3,074,054, assigned to the assignee of this invention. In such redundant sensor systems, an alarm output is provided only upon actuation of two or more sensors within a predetermined time interval. The probability that the multiple sensors will false alarm within the same time interval is very small compared to the probability of a false alarm of any single sensor. In many alarm system installations, it is desirable to provide an alarm output when any sensor of a plurality of sensors is actuated, to provide increased detection even though the false alarm rate will increase.

SUMMARY OF THE INVENTION

In brief, the present invention provides a multiple sensor alarm system having two output modes, one providing relatively high detection probability, the other providing relatively low false alarm probability. The invention is applicable to alarm systems of different types such as intrusion and fire alarm systems as well as other alarm systems in which sensors are actuable by a predetermined condition such as temperature, pressure and the like. The novel system comprises two or more sensors providing overlapping coverage of an area or condition and coupled by means of an OR circuit to a first alarm, and coupled by means of an AND circuit to a second alarm. The first alarm is triggered by actuation of any one of the sensors to thereby provide high detection performance. The second alarm is triggered only by actuation of the two or more sensors simultaneously or within a predetermined time interval to achieve a low false alarm rate. The first alarm is typically a local alarm indicator where a higher probability of detection is desirable even though the false alarm rate is higher. The second alarm is typically a remote alarm indicator at a police or fire station or central station where desirably the false alarm rate should be low.

DESCRIPTION OF THE DRAWING

The invention will be more fully understood from the following detailed description taken in conjunction with the drawing, the single FIGURE of which is a block diagram representation of an alarm system embodying the invention.

DETAILED DESCRIPTION OF THE INVENTION

Referring to the drawing there as shown first and second sensors 10 and 12 each coupled to respective multivibrator 14 and 16, the output of each multivibrator being coupled to one input of respective AND gates 18 and 20. Sensor 10 is also coupled to one input of an OR gate 22 and to the second input of AND gate 20. Sensor 12 is coupled to the other input of OR gate 22 and to the second input of AND gate 18. The output of OR gate 22 is coupled to a local alarm 24. The output of gates 18 and 20 are coupled to respective inputs of an OR gate 26, the output of which is coupled to a remote alarm 28. Although two sensors are illustrated, it will be appreciated that additional sensors can be employed.

The sensors can themselves be of any well known type providing an output signal in response to an intended sensed condition. These sensors can be, for example, intrusion sensors for detection of an intruder in a protected area, or fire sensors of heat and/or smoke types for detection of fire in a protected area. The sensors employed according to the invention provide overlapping coverage of an area or zone so that sensor redundancy can provide reduced false alarm rates in one of the two operative modes.

Upon actuation of any one sensor, say sensor 10, the associated multivibrator 14 is triggered and provides a gate pulse to the associated AND gate 18. If the other of the sensors, here sensor 12, is actuated within the time interval defined by the multivibrator gate signal, the AND gate 18 provides an output signal via OR gate 26 to remote alarm 28. The remote alarm is thus actuated upon the actuation of both sensors 10 and 12 nearly simultaneously, that is, within the time interval defined by the multivibrator gating signal. The local alarm 24 will also be actuated upon triggering of any one or more of the sensors, the sensor signals being coupled to the local alarm via OR gate 22.

If only one sensor 10 or 12 is actuated, the sensor output signal is coupled via OR gate 22 to the local alarm 24 for actuation of that alarm. The remote alarm 28 is not energized in response to single sensor actuation, since the corresponding AND gate will not be operative in the absence of a second input signal from the other sensor. The local alarm 24, being actuated by the triggering of any one or more of the sensors, provides relatively high detection reliability. This local alarm is typically an intrusion alarm or fire alarm bell or siren at a protected facility where detection reliability is important and higher false alarm rates can be tolerated. The remote alarm 28 is actuated only upon the nearly simultaneous triggering of the multiple sensors to achieve a relatively low false alarm rate. Such remote alarm typically is an alarm indicator at a central station, or police or fire station where lower false alarm rates are important to the orderly management of such a facility.

The invention can be employed with any number of sensors, and all of the multiple sensors or a lesser group in a zone of overlapping coverage can be embodied in the invention to provide two modes of alarm operation. The invention is not to be limited by what has been shown and described except as indicated in the appended claims.

What is claimed is:

1. An alarm system comprising:

a plurality of sensors providing overlapping coverage of a common protected area and each providing a sensor signal when actuated by an alarm condition in the protected area;

OR circuit means coupled to said sensors and operative in response to any one of the sensor signals to provide a first alarm signal having high detection reliability; and logic circuit means coupled to said sensors and operative in response to sensor signals from at least two of said sensors present within a predetermined time interval to provide a second alarm signal having a low false alarm rate;

said time interval commencing immediately upon the occurrence of the first of said sensor signals.

2. The systems of claim 1 further including:

a local alarm coupled to said OR circuit means and operative in response to said first alarm signal to provide a local alarm indication of high detection reliability; and;

a remote alarm coupled to said logic circuit means and operative in response to said second alarm signal to provide a remote alarm indication of low false alarm rate.

3. The system of claim 2 wherein said logic circuit means includes for each of said sensors:

a gating circuit operative in response to a sensor signal from the associated sensor and defining a predetermined time interval;

an AND gate operative in response to said gating signal and a sensor signal from at least one other of said sensors to provide an output signal from which said second alarm signal is derived.

4. The system of claim 3 wherein said logic circuit means further includes:

an OR circuit coupled to said AND gates and operative in response to any one of said output signals to provide said second alarm signal.

5. An alarm system comprising:

a plurality of sensors providing overlapping coverage of a common protected area and each providing a respective sensor signal when actuated by an alarm condition in the protected area;

an OR circuit coupled to said plurality of sensors and operative in response to any one of the sensor signals therefrom to provide a first alarm signal having high detection reliability;

a logic circuit for each of said sensors operative in response to the simultaneous presence of a gating signal derived from a sensor signal from one of said sensors and a sensor signal from at least one other of said sensors to provide an output signal; and an OR circuit operative in response to any one of said output signals to provide a second alarm signal having a low false alarm rate;

said gating signal commencing immediately upon the occurrence of the first of said sensor signals.

* * * * *